United States Patent [19]

Kampert

[11] 3,989,606

[45] Nov. 2, 1976

[54] METAL PLATING ON ALUMINUM

[75] Inventor: William P. Kampert, Lower Burrell, Pa.

[73] Assignee: Aluminum Company of America, Pittsburgh, Pa.

[22] Filed: Sept. 26, 1975

[21] Appl. No.: 617,184

[52] U.S. Cl. ..... 204/33; 204/29; 204/38 B

[51] Int. Cl.[2] ..... C25D 5/44

[58] Field of Search ..... 204/29, 33, 38 B

[56] References Cited

UNITED STATES PATENTS

| | | | |
|---|---|---|---|
| 2,142,564 | 1/1939 | Korpiun | 91/68.2 |
| 2,662,054 | 12/1953 | Passal | 204/33 |
| 2,739,932 | 3/1956 | Forestek | 204/38 |
| 2,745,799 | 5/1956 | Patrie | 204/38 |
| 3,493,474 | 2/1970 | Weber | 204/33 |

FOREIGN PATENTS OR APPLICATIONS

| | | | |
|---|---|---|---|
| 500,113 | 2/1939 | United Kingdom | 204/33 |

*Primary Examiner*—G. L. Kaplan
*Attorney, Agent, or Firm*—John P. Taylor

[57] ABSTRACT

An improved process for metal plating on aluminum wherein a zinc immersion coating is applied to the aluminum to dissolve undesirable oxides on the aluminum surface. The improvement comprises a controlled dissolution of the zinc layer followed by immediate plating of the surface with another metal such as nickel. The dissolution of the zinc surface is monitored by immersing the zinc-coated aluminum, together with a nickel electrode, in an electrolytic bath and monitoring the electrode potential difference between the electrodes. The subsequent metal plating step is commenced when the electrode potential difference between the electrodes falls about 100–200 millivolts below the initial electrode potential difference at the particular temperature and bath composition.

8 Claims, 1 Drawing Figure

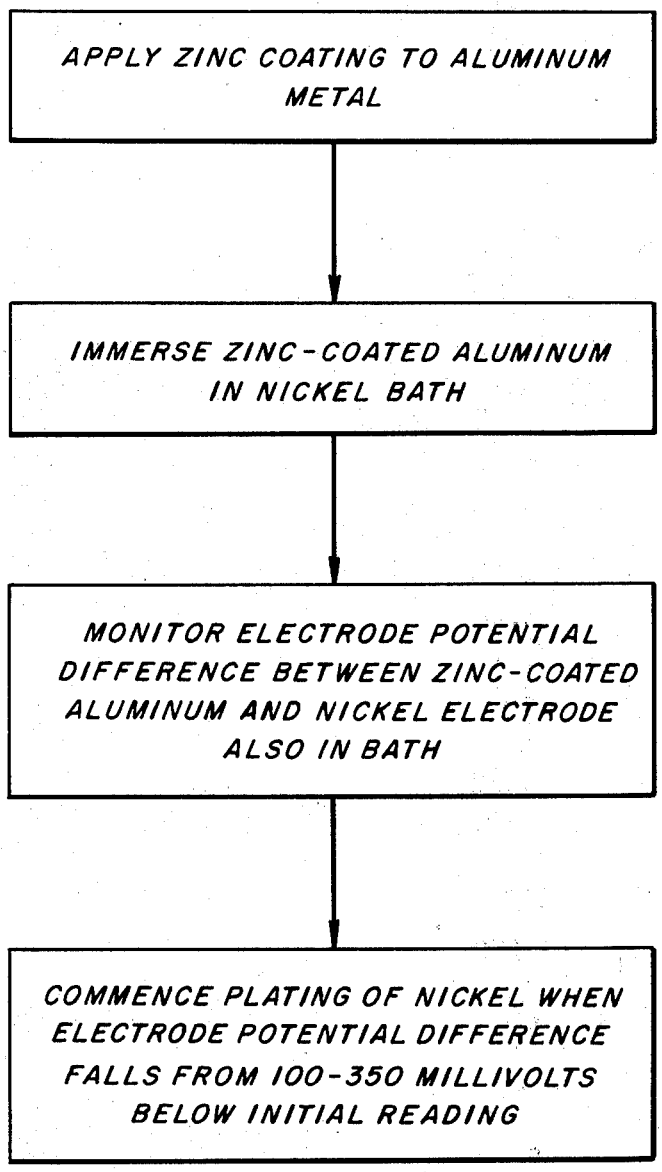
APPLY ZINC COATING TO ALUMINUM METAL
IMMERSE ZINC-COATED ALUMINUM IN NICKEL BATH
MONITOR ELECTRODE POTENTIAL DIFFERENCE BETWEEN ZINC-COATED ALUMINUM AND NICKEL ELECTRODE ALSO IN BATH
COMMENCE PLATING OF NICKEL WHEN ELECTRODE POTENTIAL DIFFERENCE FALLS FROM 100-350 MILLIVOLTS BELOW INITIAL READING

METAL PLATNG ON ALUMINUM

BACKGROUND OF THE INVENTION

This invention relates to metal plating on aluminum. More particularly, this invention relates to an improved process to provide an adherent coating of metal on aluminum which may provide the basis for subsequent electroplating of other metals thereon.

Natural oxides on aluminum inhibit the direct electroplating thereon of other metals. To overcome this difficulty, it has become a standard practice to immerse the aluminum in an alkaline-zincate solution. This treatment results in dissolution of the aluminum oxide surface and a deposition of zinc thereon which in turn apparently prevents any further formation of aluminum oxide on the surface. Korpiun U.S. Pat. No. 2,142,564 describes such a typical process while teaching the addition of copper salts as well to such a zincate bath.

Usually, such zinc deposition is followed by electroplating of copper and/or nickel thereon to provide a proper base layer for the subsequent deposition of a final layer such as chromium. Patrie U.S. Pat. No. 2,745,799, for example, teaches the deposition of zinc from an alkalicyanide bath followed by the plating of nickel thereon.

Unfortunately, however, while the treatment with zinc dissolves the undesired aluminum oxide surfaces, subsequent exposure of the plated aluminum surface to a corrosive environment can result in an undermining type of corrosion due to zinc being anodic to both the plated metal top coat and the aluminum substrate.

This problem has been previously recognized and others have attempted to remove the zinc coating on the aluminum prior to commencing subsequent plating operations. For example, Passal U.S. Pat. No. 2,662,054 uses an alkali metal zincate solution which he then dissolves by immersing the coated aluminum article in a "known chromic acid-catalyst radical chromium plating bath". Passal states that the aluminum article is connected in an electric circuit as a cathode but the circuit connection is not necessarily made at the time the zinc and copper coated aluminum article is first immersed in the solution. He does, however, state that the plating should commence within 15 seconds after the article has been immersed in the chromium plating electrolyte. Forestek U.S. Pat. No. 2,739,932 also applies a zinc coating to the aluminum to replace the oxide film and prevent reoxidation. He then subsequently removes this zinc coating by immersing the coated aluminum member in a concentrated electrolytic solution including chromic acid and sulfuric acid which is also used as the plating bath for plating chromium onto the aluminum article.

While these processes for dissolving the zinc layer have met with some measure of success in alleviating the corrosion problem, it has been found that (at least when using an intermediate nickel layer beneath the subsequent layer of, for example, chrome or the like) if the zinc-coated aluminum article is permitted to remain for too long a period of time in the dissolving medium, some sort of passivation reaction appears to occur which interferes with the formation of a good metal to metal bond upon subsequent plating of the aluminum article.

It is therefore an object of this invention to provide a process for plating of aluminum using an intermediate zinc coating wherein the zinc coating is removed using a controlled removal process which provides an accurate monitoring of the removal rate and interrupts the removal of the zinc at a predetermined point.

SUMMARY OF THE INVENTION

In accordance with the invention, an improved process for plating aluminum wherein the aluminum is first coated with zinc and then plated with another metal is provided which comprises removing a portion of the zinc coating prior to plating by immersing the zinc-coated aluminum in an acidic bath and electrically connecting the zinc-coated aluminum to a nickel electrode in the bath and monitoring the electrode potential difference between the zinc-coated aluminum electrode and the nickel electrode as the zinc dissolves. The plating operation is then commenced by applying an external potential to the electrodes when the electrode potential difference decreases about 100–200 millivolts signifying substantial removal of the zinc layer.

BRIEF DESCRIPTION OF THE DRAWING

The sole DRAWING of the invention is a flowsheet illustrating the process.

DESCRIPTION OF THE INVENTION

The aluminum surface, prior to desired plating operations, must be preliminarily subject to conventional cleaning steps such as are well known to those skilled in the art and referred to in one or more of the above-cited U.S. patents. Basically, such steps involve removal of external dirt or grease using an organic solvent followed by etching in alkali solution, rinsing, and then removal of any smudge by dipping in an acid solution. Following rinsing, the aluminum surface is then ready for the initial zinc coating.

These conventional preliminary treatments can include wiping the metal samples in an organic solvent such as acetone or the like, followed by etching from 0.5 to 5 minutes in a conventional etching solution such as, for example, a 5% sodium hydroxide solution at about 60° C. The surface is then desmutted for about 30 seconds in an acid bath such as, for example, concentrated nitric acid solution (about 40% by weight) at room temperature.

Following this treatment, the cleaned aluminum substrate is conventionally coated with zinc, for example, by immersing the substrate for 30 seconds in a concentrated zinc solution containing 500 grams per liter NaOH, 100 grams per liter zinc oxide, 10 grams per liter Rochelle salts and 1 gram per liter ferric chloride. This bath is maintained at about room temperature, i.e. from about 20° to 30° C, preferably about 25° C. Following this coating treatment, the aluminum article is removed from the zinc bath, rinsed, and treated for 1 minute in a concentrated acid bath at about room temperature to strip the zinc from the surface. This stripping action can be carried out, for example, in a concentrated nitric acid bath comprising about 50% by weight nitric acid.

Following this acid stripping treatment the aluminum article is again rinsed and a second zinc coating applied by immersing the aluminum article in the same zinc bath or a zinc bath of similar concentration. This time the immersion is carried out for about 60 seconds and at about the same temperature range, i.e. 20° to 30° C and preferably about 25° C. The coated aluminum article is then removed from the zinc bath, rinsed with water and placed in the metal plating bath.

While, in the preferred embodiment the double application of the zinc coating is used to provide a zinc coating of more uniform thickness and composition, it is within the scope of this invention to use a single application of zinc coating.

In accordance with the invention, the zinc coating on the aluminum article is now removed by immersing it in a bath which, after the desired removal, is then used as a plating bath to plate another metal on the surface of the aluminum article. The metal plating bath, in the preferred embodiment, is a nickel plating bath containing about 300–412 grams per liter (1.14–1.56 moles) of nickel sulfate ($NiSO_4 \cdot 6H_2o$) and about 45 grams per liter of boric acid.

A wetting agent can also be added if desired although it has not been found to be necessary to use a wetting agent. If such an agent is used, a concentration of about 20–40 milliliters per liter of solution is satisfactory. Examples of wetting agents which can be used include sodium lauryl sulfate or sodium lauryl ethoxy sulfate.

Such wetting agents can also act as non-pitting agents by preventing hydrogen bubbles from adhering to the surface of the aluminum article. Alternatively, if desired, a non-pitting agent such as an unsaturated organic depolarizing agent can be added as a separate ingredient. Examples of such compounds include, for example, formaldehyde, unsaturated aliphatic sulfonic acids, or monosulfobenzaldehyde. Such agents, when used, are added in a concentration of about 20 ml per liter of solution. If desired, other brightening agents may also be used in small concentrations of about 0.2 to 1.2 milliliters per liter of solution, which brightening agents include, for example, sulfonates, sulfonamides and benzene.

The pH of the bath is maintained at from 3.5 to 4.5 by respective additions of sulfuric acid to lower the pH or nickel carbonate to raise the pH (other nickel salts can be used instead of sulfates). However, it should be further noted that, in accordance with the invention, no halogen salts are used in the nickel plating bath. Halogen ions have been found to interfere with uniform dissolution of the zincate coating.

The nickel plating bath is maintained at a temperature of from about 20° C to 40° C. The bath is agitated by any conventional means to maintain a uniform concentration during the dissolution and plating steps.

A solid nickel electrode is also immersed in the nickel plating bath. The two electrodes are then electrically connected to a voltmeter such as, for example, a digital readout voltmeter. The electrodes are also attached electrically to a source of plating current. However, this source of plating current is not immediately activated as will be explained. In a preferred embodiment, two such nickel electrodes are used, one on either side of the zinc-coated electrode.

Immediately following the immersion and electrical connection of the zinc-coated aluminum article and the nickel electrodes, a potential is measurable between the zinc-coated aluminum article and the nickel electrode. This potential will vary somewhat depending upon the temperature of the bath, the concentration of nickel in the bath, and the concentration of iron or other metals (e.g. nickel and copper) in the zinc coating on the aluminum article (inclusion of up to 6 grams of iron per liter of zincate solution has been found to be desirable in some instances to promote adhesion).

The potential basically represents the difference between a zinc electrode and a nickel electrode in the electromotive series and is therefore measurable in millivolts. As the zinc (anode) dissolves, the zinc-coated aluminum article becomes a mixed electrode which may be zinc and nickel or zinc and aluminum oxide rather than a pure zinc electrode. When the electrode potential falls a predetermined amount below the initial reading, the external plating circuit is activated to apply a potential across the electrodes to cause nickel to deposit on the aluminum cathode. This predetermined amount is usually about 100–200 millivolts below the initial reading. The change, however, can be as much as 450 millivolts. A change of about 150 millivolts is, however, preferred for the commencement of the plating.

Nickel is deposited for several minutes to increase nickel thickness to prevent passivation of the aluminum surface. For example, application of 3.5 to 4.0 volts (depending upon the spacing apart of the nickel electrodes from the aluminum article which can be about 9–10 cm) to provide an initial current density of 2 amps/dm$^2$ has been found to be satisfactory.

The nickel-plated specimen is then removed from the plating bath. In a preferred embodiment, the specimen is removed "hot", i.e. with a voltage maintained across the load until the electrode is completely removed from the bath. The specimen is then treated as a nickel electrode with subsequent plating of additional nickel if desired plus other conventional plating such as, for example, chrome plating or the like. The following example will serve to further illustrate the invention.

EXAMPLE 1

A number of test specimens each having dimensions of about 7.6 × 8.2 centimeters by 1.3–3.5 millimeters thick comprising Aluminum Association Alloys 1100, 2024, 3003, 5052, 6061, 6063, and 7075 as well as a special aluminum alloy having the following alloying constituents: 7.5% by wt. Zn, 1.3% by wt. Mg, and 0.1% by wt. Fe were all tested to determine the efficacy of the process. In each instance the samples were wiped clean with acetone, etched for about 30 seconds at 60° C in a 5% sodium hydroxide solution, rinsed with water, desmutted for about 1 minute in a nitric acid solution (about 40% by weight), rinsed, and then immersed for 30 seconds in a zinc immersion bath at room temperature, the zinc bath comprising the following ingredients: 500 grams per liter NaOH, 100 grams per liter ZnO, 10 grams per liter $KNaC_4H_4O_6 \cdot 4H_2O$ (Rochelle salt) and 1 gram per liter $FeCl_3 \cdot 6H_2O$. The samples were then removed from the zinc immersion bath, rinsed, immersed for 1 minute in the same nitric acid bath at room temperature, removed and rinsed and then immersed again for 60 seconds in the same zinc immersion bath again at room temperature.

Following this treatment, the samples were each removed, rinsed, and then were placed in a nickel plating bath which comprised 375 grams per liter nickel sulfate, 45 grams per liter boric acid, and 4.8 ml/liter Udylite Non-Pitter No. 22. The pH of the nickel plating bath was about 3.6 to 4.5 and the temperature was maintained between about 35 to 40° C. The bath was stirred with mechanical agitation. Nickel electrodes measuring 10 × 25 centimeters by 5 centimeters thick were placed in the plating bath at a distance of 10 centimeters from the zinc-coated aluminum electrode. The zinc-coated aluminum electrode and the nickel electrode were each electrically connected to a Digitec digital readout voltmeter and to the opposite electrodes of a power supply having a manual switch to instantly provide a plating current to the electrodes when desired. In each instance, the electrode potential across the nickel electrode and the zinc-coated aluminum electrode was monitored. When the voltage dropped about 150 millivolts, the plating current was applied to the electrodes at a current density of 2 amps/dm$^2$ and a voltage of about 4.0 volts. This plating voltage and current were applied for 2 minutes. In each instance, the aluminum electrode was then removed and immersed in a conventional semi-bright nickel plating bath containing 375 grams per liter nickel sulfate, 45 grams per liter boric acid, 33 grams per liter nickel chloride·3½$H_2O$, 20 ml/liter Udylite Non-Pitter No. 22, and 0.2–1.2 ml/liter Udylite Brightener 2N. The electrodes were in each instance plated for 20 minutes at 60° C and a current density of 4.3 amps/dm$^2$.

Each of the plated electrodes was then further plated in a conventional bright nickel bath containing 375 grams per liter nickel sulfate, 45 grams per liter boric acid, 33 grams per liter nickel chloride·3½$H_2O$, 1.25 ml/liter Udylite Brightener 91, 20 ml/liter Udylite Brightener 7, and 6 ml/liter Udylite Brightener 4. The electrodes were plated for 10 minutes at 60° C and a current density of 4.3 amps/dm$^2$.

To test the corrosion resistance of the subsequent nickel plating to the aluminum substrate, the panels were subjected to a CASS test in accordance with ASTM B 328-68 in which each panel was inscribed through the plate to a depth of about 0.01 centimeters to expose the substrate below the nickel plating. The specimens were then immersed for 12 hours in the CASS test bath. Each plate was then examined to determine if any delamination of the plate had occurred. A control plate was also used in which the same double zinc treatment was applied as well as the same nickel plating treatment but the zinc removal treatment of the invention was omitted. Only the control plate exhibited delamination.

A second control plate, permitted to go to zero potential in the zinc dissolution step, was also prepared. However, when it was scribed for the CASS test, the overplate could be lifted from the substrate — thus indicating delamination even before application of the CASS test. This illustrated the need, in accordance with the invention, for careful monitoring of the voltage drop during the dissolution step to ensure that plating commences prior to dropping of the voltage beyond the specified amount.

While the invention has been described in terms of preferred embodiments, the claims appended hereto are intended to encompass all embodiments which fall within the spirit of the invention.

Having thus described the invention and certain preferred embodiments thereof, What is claimed is:

1. An improved process for plating aluminum wherein said aluminum is first coated with zinc and then coated with another metal prior to application of a final metal plating step which comprises:

removing a portion of said zinc coating prior to application of said other metal coating by immersing said zinc-coated aluminum in an acidic bath containing ions of the other metal and ionically connecting said zinc-coated aluminum to an electrode of the other metal in said bath;

monitoring the electrode potential difference between the zinc-coated aluminum electrode and the electrode of the other metal as the zinc dissolves; and applying an external potential to said electrodes after the electrode potential difference falls about 100 millivolts below the initial reading signifying substantial removal of the zinc layer thereby commencing electroplating of the other metal on said zinc-coated aluminum.

2. The process of claim 1 wherein said other metal is nickel.

3. The process of claim 2 wherein said metal plating bath comprises 1.14–1.56 moles of nickel.

4. The process of claim 3 wherein said nickel plating bath is maintained at a pH of 3.5 to 4.5 and a temperature of 20°–40° C.

5. In an improved process for electroplating aluminum wherein a zinc coating is applied and removed prior to the electroplating step, the improvement which comprises immersing the zinc-coated aluminum in a bath containing nickel ions but no halogen ions in ionic communication with a nickel electrode to dissolve the zinc until the electrode potential difference between the nickel electrode and the zinc-coated aluminum falls to 100–450 millivolts below the initial electrode potential difference and instantly thereafter commencing said electroplating step.

6. An improved process for plating aluminum wherein said aluminum is first coated with zinc and then coated with nickel prior to application of a final metal plating step which comprises:

removing a portion of said zinc coating prior to application of said nickel coating by immersing said zinc-coated aluminum in an acidic bath containing nickel ions and ionically connecting said zinc-coated aluminum to a nickel electrode in said bath;

monitoring the electrode potential difference between the zinc-coated aluminum electrode and the nickel electrode as the zinc dissolves; and applying an external potential to said electrodes after the electrode potential difference falls from about 100 millivolts to about 450 millivolts below the initial reading signifying substantial removal of the zinc layer thereby commencing electroplating of the nickel on said zinc-coated aluminum.

7. The process of claim 6 wherein said electrode potential difference is permitted to fall 100–200 millivolts below the initial electrode potential difference before application of said external potential.

8. The process of claim 7 wherein said electrode potential difference is permitted to fall about 150 millivolts below the initial electrode potential difference.

* * * * *